US006315285B1

(12) United States Patent
Brugger et al.

(10) Patent No.: US 6,315,285 B1
(45) Date of Patent: Nov. 13, 2001

(54) MEDIA ADJUSTMENT GUIDES FOR IMAGE FORMING APPARATUS

(75) Inventors: Charles E. Brugger; Scott P. Haude, both of Rochester; Craig F. Robillard, Spencerport; Robert M. Westcott, Holley, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/672,245

(22) Filed: Sep. 28, 2000

(51) Int. Cl.[7] ..... B65H 1/00
(52) U.S. Cl. ..... 271/145; 271/171
(58) Field of Search ..... 271/145, 147, 271/171, 241

(56) References Cited

U.S. PATENT DOCUMENTS

| | | | | |
|---|---|---|---|---|
| D. 364,185 | | 11/1995 | McCue et al. . | |
| 4,780,740 | | 10/1988 | Fukae . | |
| 4,907,792 | | 3/1990 | Washiashi et al. . | |
| 4,949,134 | | 8/1990 | Iwaki et al. . | |
| 5,014,091 | | 5/1991 | Koike et al. . | |
| 5,148,228 | | 9/1992 | Takano . | |
| 5,292,117 | * | 3/1994 | Takagi et al. | 271/171 X |
| 5,411,248 | * | 5/1995 | Yamaguchi | 271/171 |
| 5,611,528 | | 3/1997 | Nakamura et al. . | |
| 5,713,569 | | 2/1998 | Girard et al. . | |
| 5,749,294 | | 5/1998 | Ruf et al. . | |
| 5,931,456 | | 8/1999 | Laidlaw . | |
| 6,000,692 | | 12/1999 | Lee . | |

FOREIGN PATENT DOCUMENTS

| | | | | |
|---|---|---|---|---|
| 5-319582 | * | 12/1993 | (JP) | 271/171 |

* cited by examiner

*Primary Examiner*—David H. Bollinger
(74) *Attorney, Agent, or Firm*—Harleston Law Firm

(57) ABSTRACT

A media supply receptacle (10) includes: a) a horizontally inclined base plate (18); b) a movable, slotted input tray (14) generally parallel to and above the base plate (18), with a generally flat upper surface for supporting a stack of sheet media; c) evenly spaced, parallel control rod slots (15) in the input tray; and d) at least one media adjustment guide member (11), which includes identical, evenly spaced control rods (12). The control rods are vertically positioned with respect to the horizontally aligned input tray (14), and at least one passes through a corresponding control rod slot (15). Each control rod (12) has a lower end affixed to the base plate, and an opposite, upper end affixed to a guide cap. Each guide cap (13) extends across the upper ends of the control rods (12) in the guide member (11) and over the input tray. The receptacle (10) is adapted for feeding the stack of sheet media to the adjacent image forming or rendering apparatus, a sheet at a time.

18 Claims, 5 Drawing Sheets

MEDIA ADJUSTMENT GUIDES FOR IMAGE FORMING APPARATUS

FIELD OF THE INVENTION

The invention relates to receptacles for supplying printable media sheets to image forming or rendering apparatus, such as scanners, photocopiers and printers, and more particularly to media adjustment guides on such media supply receptacles.

BACKGROUND OF THE INVENTION

Media supply receptacles, often paper trays, are included on most image forming/rendering apparatus, such as printers, scanners and photocopiers, for supplying printable media, commonly sheets of paper, to the image forming apparatus. Media adjustment guides, also called paper side guides, are included on many media supply receptacles for further accommodating nonstandard sized media, such as envelopes and postcards. Most media adjustment guides are designed to keep the stack of media in the media receptacle organized before it enters the image forming/rendering portions of the apparatus.

Adjustable, side by side poles or rods can be used as side guides for preventing dishevelment of a stack of documents in an automatic document feeding device for a machine for scanning and digitization of documents. These side guides control stack straightness, but generally do not assist in the control of skew, or rotation, of the documents.

In general, control of paper skew in printer paper trays is often accomplished with an elongated (relative to the length of the media) control edge, which is held in alignment with a document feeder. In order to accommodate a full range of media stack heights, the guides having these control edges must be relatively high. Unfortunately, tall fixed-height guides restrict operator access to shorter stacks of media, and complicate loading and adjustment of documents in the feeder.

Some automatic document feeding systems incorporate a moving platen input tray or input tray to elevate a stack of documents for feeding. In such systems attachment of document side guides in relation to the moving platen/stack support mechanism results in reduced precision in parallelism between the guides and the feeding mechanism due to tolerance build-up.

The present invention is a media receptacle for use with an automatic document feeding device in a machine for scanning and digitization of documents or the like. The receptacle comprises a horizontal base plate with adjustment guide members vertically mounted on it, and a movable, slotted input tray generally parallel to and above the base plate. The adjustment guide members include control rods which project through the control slots in the input tray. Guide caps on the upper ends of the guide members prevent the input tray from being easily removed, and guide the edges of the media. The control rods support the guide caps and allow elevation of the input tray, which is raised or lowered to accommodate varying numbers (capacity) of media sheets.

The present invention conveys three major benefits. First, the combination of control rods and guide caps receptacle adjustment guides of the present invention have optimized guide surfaces for a wide variety of document stack heights. Both document skew and dishevelment of the stack of documents are controlled. Secondly, the tops of the adjustment guides combination of control rods and guide caps do not project substantially above the paper stack, so the operator of the image forming apparatus has better visual and manual access to the document stack and the receptacle. This would not be the case in conventional one piece edge guides that are typically sized with a height slightly larger than the maximum intended media stack height. An example of this advantage is the case where an operator only needs to feed a small stack height say one to ten sheets of paper. In a conventionally configured edge guiding system, the edge guide would be sized at about five inches of height in order to allow for the feeding of a 1,000 sheet stack. In this instance, the operator would need to contend with an edge guide with approximately four or more inches of unnecessary height, thereby causing reduced visual and manual accessibility. In the present invention, the control rods and guide cap combination allows for the maximum capacity case, but will also allow the input tray to be raised to a level where only the edge guiding cap is exposed. This allows the operator to feed small and large stacks with optimized visual and manual accessibility. This increased accessibility translates to increased productivity and operator satisfaction. Thirdly, the media adjustment guides combination of control rods and edge guide caps of the present invention are adjustable for a wide variety of media widths.

The present invention includes media adjustment guides which combine the attributes of control rods for stack control and long guiding faces for skew control. The adjustment guide members of the present invention are shaped like pick-type combs. These guides improve operator access to the document stack by coordinating the height of the guides to the loading position of the movable platen input tray/stack support. The present invention also provides improved control of stacks of input documents during feeding. In addition, the adjustment guides are mounted directly to the frame of the image forming machine, and not to a movable input tray elevator platen. This reduces tolerance build-up and provides more consistent alignment of the adjustment guides to the feed mechanism.

The present invention provides an optimized paper guide approach with the benefit of an optimized height guide for any given stack. The media receptacle of the present invention largely prevents a media stack in the receptacle from becoming disheveled and prevents the sheets of media in the stack from becoming skewed. The present invention controls dishevelment and skew even in tall or very short media stacks. Also, the media receptacle of the present invention is adjustable for various media widths and lengths. Another advantage of the present invention is that it can be operated manually or automatically, as in the case of a photocopier or printer paper supply.

SUMMARY OF THE INVENTION

The present invention is a media supply receptacle for holding a stack of printable sheet media prior to image forming or scanning in an image forming or rendering apparatus. The receptacle comprises:

a) a horizontally inclined base plate having a generally flat upper surface;

b) a movable, slotted input tray generally parallel to and above the base plate, the input tray having a generally flat upper surface adapted for contacting a bottom sheet of a plurality of sheet media, the input tray being adapted for supporting the stack of sheet media;

c) a plurality of evenly spaced control rod slots in the input tray, each control rod slot being parallel to and set in the same plane as the other control rod slots; and d) at least one media adjustment guide member, each adjustment guide member comprising a plurality of generally identical, evenly spaced control rods, each control rod being vertically positioned with respect to the horizontally inclined input tray, at least one control rod passing through a corresponding control rod slot, at least one control rod having a lower end movably or immovably affixed to the base plate, and an opposite, upper end affixed to a guide cap, each guide cap extending across the upper ends of the control rods in the adjustment guide member and over the input tray;

wherein the receptacle is adapted for feeding the stack of sheet media in the receptacle to the adjacent image forming or rendering apparatus, a sheet at a time.

The invention and its advantages will become more apparent in the detailed description of the preferred embodiment presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus and methods in accordance with the present invention. It is to be understood that elements, or steps, not specifically shown or described may take various forms well known to those skilled in the art.

Figure 1:
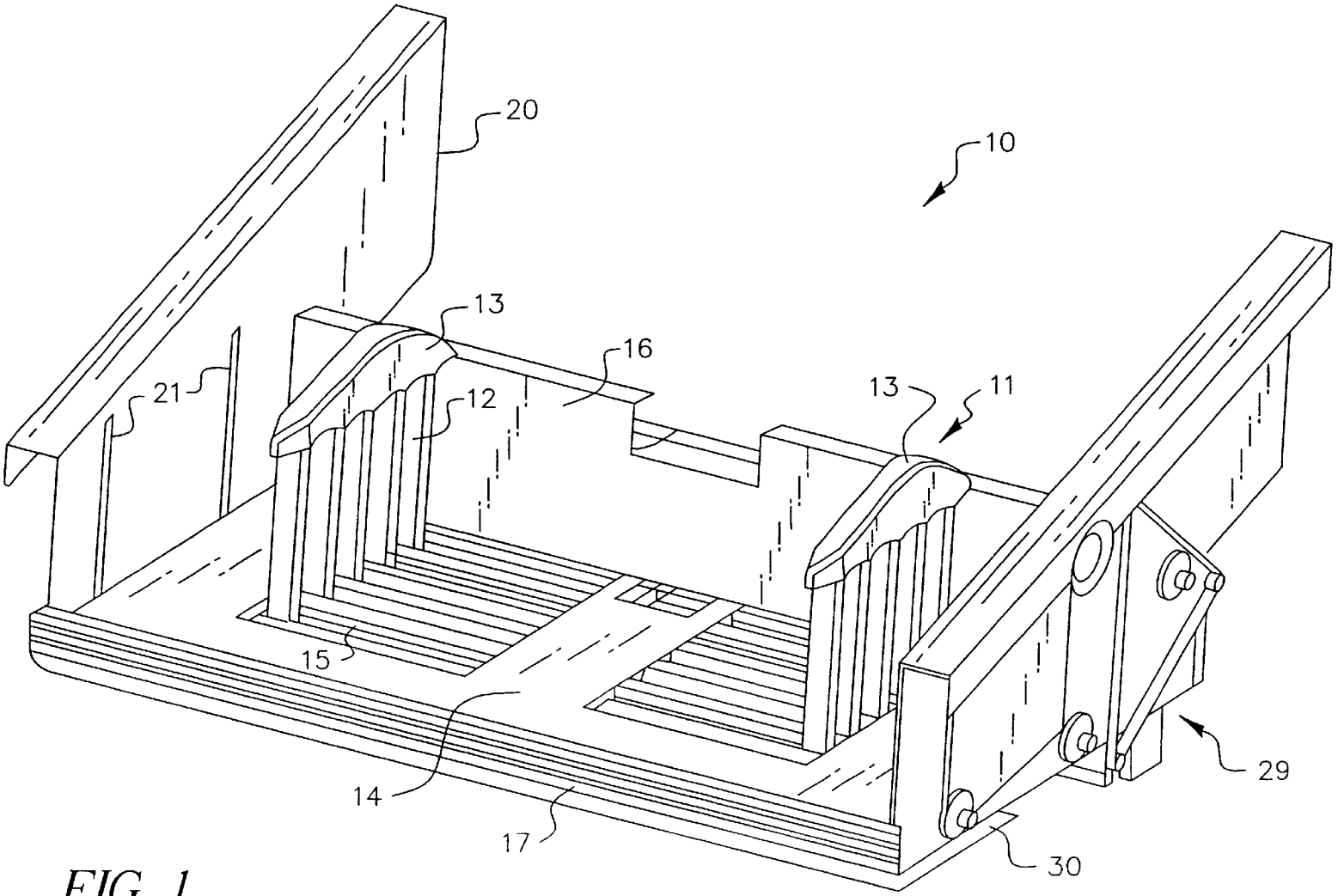
FIG. 1 is a perspective view of a media supply receptacle according to the present invention, shown in a full stack capacity position.

Referring to FIG. 1, a preferred embodiment of a media supply receptacle of the present invention is shown in a full stack capacity position, which is the "home" position. At least one, and preferably two guide adjustment members 11 are vertically mounted in a media receptacle 10. As shown in FIG. 1, the two guide adjustment members are preferably parallel to each other, and are positioned for contact with opposite sides of the stack of printable media. In a receptacle as shown in FIG. 1, the media stack, which is most often a stack of copy paper, is positioned between the two guide members. When the media is stacked in the receptacle, one media adjustment guide member 11 contacts the left side of the media stacked in the receptacle, and one guide member 11 contacts the right side. By "stacked" is meant that two or more sheets of the media sheets to be copied/printed are held in place on top of one another in the receptacle ready for feeding to the apparatus. In order to accommodate varying paper sizes, the media adjustment guide members 11 are preferably movable toward or away from each other. The guide members are made from polymeric plastic compounds or other suitable materials.

Continuing with FIG. 1, each media adjustment guide member 11 is comprised of a plurality of identical, evenly spaced control rods 12. From about five to seven control rods and corresponding control slots are preferred. In FIG. 1, each control rod is parallel to the other control rods. The rods are set in a common plane, and resemble teeth in a pick-like comb. The upper ends of the control rods are affixed to a guide cap 13. Each guide cap 13 extends across the upper end of the control rods 12 in the guide member 11. The control rods preferably have at least one generally flat face facing inward toward the center of the receptacle. The control rods can be rod-shaped or oval-shaped, but they are most preferably rectangular in cross section. The flat faces of the control rods along one side of a guide member contact the same side of the stack of printable media loaded in the receptacle. The series of control rods, which are attached to a common base, provide stack dishevelment control. There are preferably two identical, elongated guide caps, each one comprising a flat side face. Each guide cap is preferably about the same length as the width of the combined set of control rod slots.

Continuing to refer to FIG. 1, each control rod 12 is vertically positioned with respect to a generally horizontally aligned, movable input tray 14. The input tray 14 has a generally flat upper surface adapted for contacting a bottom sheet on the printable media stack. The input tray 14 comprises a plurality of evenly spaced control rod slots 15. Each control rod slot 15 is parallel to and set in the same plane as the other control rod slots. The control rods 12 pass vertically through the horizontal control rod slots 15. In the preferred embodiment shown in FIG. 1, one control rod fits in one control rod guide slot, and two identical sets of control rod slots are centered along the right and left halves of the input tray. In FIG. 1, the sets of control rod slots 15 do not meet in the middle of the input tray 14. The media adjustment guide members 11 are preferably movable toward or away from each other within the control rod guide slots in the input tray 14. The length of the control rod slots preferably matches the maximal adjustment settings for the guide members.

Each guide cap 13 extends over the movable input tray, as shown in FIG. 1. The guide cap is preferably elongated, with a slightly curved upper surface to protect the operator. The guide cap preferably also has flat faces along its sides for document skew control. Preferably, the guide caps 13 are about the same length as the set of control rod slots 15, and the flat sides of the two guide caps cleanly meet the left and right ends of their respective set of control rod slots. The guide caps are also preferably flat on their bottom surface. The guide caps prevent the stack support surface from being easily removed and provide the edge guiding surface for controlling the media, while the control rods support these guide caps and allow the input tray to be raised or lowered to accommodate various amounts (capacity) of media sheets.

As shown in FIG. 1, the receptacle 10 preferably further comprises a lead edge guide 16, which forms one side of the receptacle 10 in a perpendicular direction to the two media adjustment guide members 11. A flat inside face of the lead guide edge contacts one side of the stack of printable media, when there is media in the receptacle 10. The lead guide edge 16 is preferably approximately the height of the control rods 12. Even with a full stack of paper in the receptacle, the input tray 14 ordinarily will not rise any higher than the lead guide edge.

Figure 2:
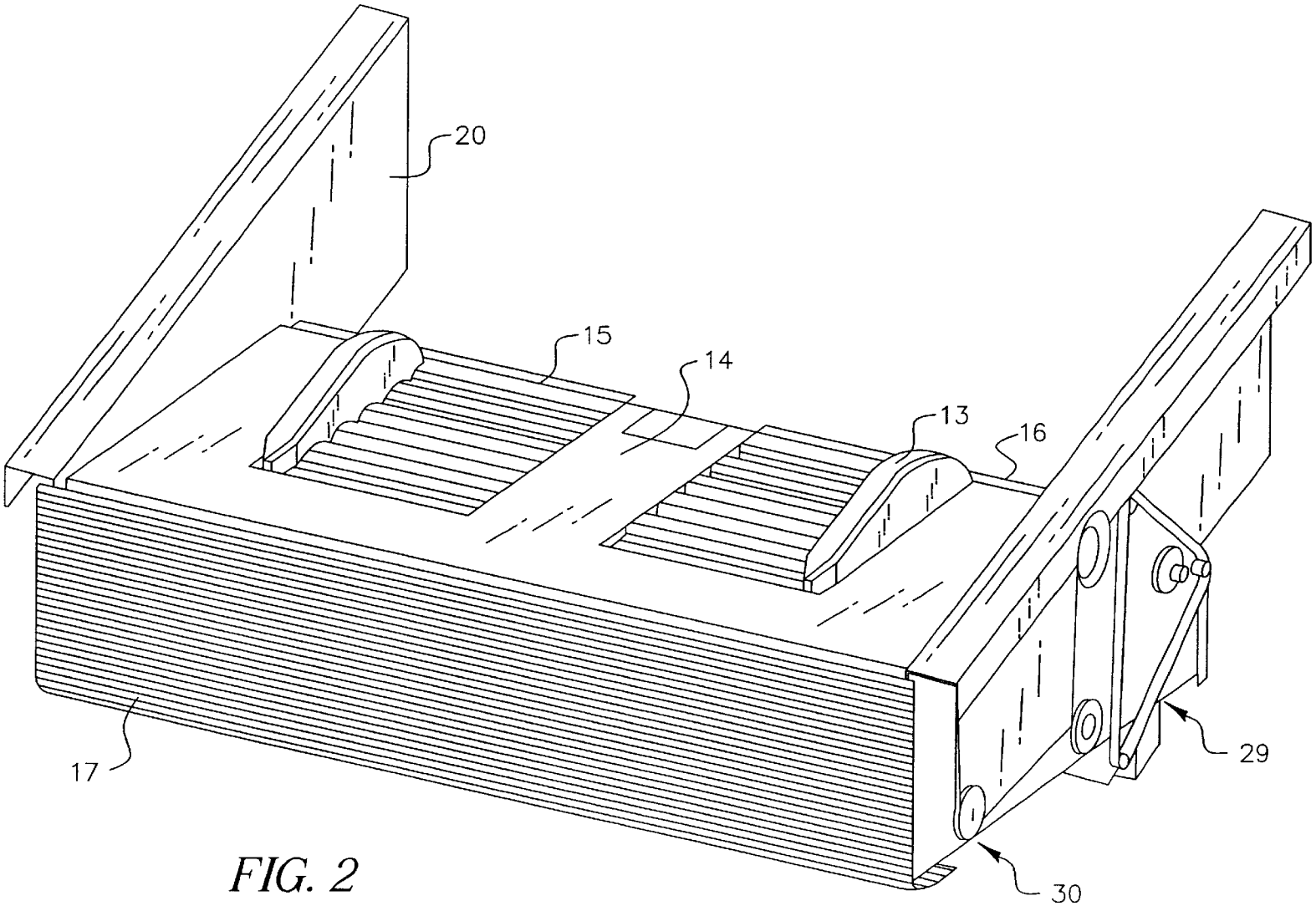
FIG. 2 is a perspective view of a media supply receptacle according to the present invention, shown in a minimum stack capacity position.

Referring to FIG. 2, the preferred embodiment is shown with the receptacle 10 in the minimum stack capacity. In FIG. 2, the guide caps 13 are shown resting on the input tray 14, and no control rods 12 are visible. This is the appearance of the receptacle when the stack of media in the receptacle 10 on the input tray is down to a few sheets. The receptacle is shown without any paper in the receptacle for discussion purposes. The guide caps 13 are optionally removably affixed to one or more upper ends of the control rods 12 in a media adjustment guide member 11, so that the guide caps can be, for example, snapped on and off the control rods. If repair or other reasons so require, the input tray can be lifted from the receptacle by first removing the guide caps.

As shown in FIG. 2, the receptacle may further comprise a flexible, movable door 17, preferably a rolling tambour door, on a front side of the receptacle. The rear side of the receptacle is connected to the image forming/rendering apparatus. An upper edge of the receptacle door is affixed to a front edge of the input tray 14, and a lower edge of the receptacle door is affixed to a front edge of the base plate. The receptacle door, which covers the space between the input tray and the base plate, is adapted for moving up and down with the input tray. To do this, the ends of the individual segments of the tambour door are movably affixed in two curved door tracks which run from the ends of the input tray to the ends of the base plate.

Figure 3:
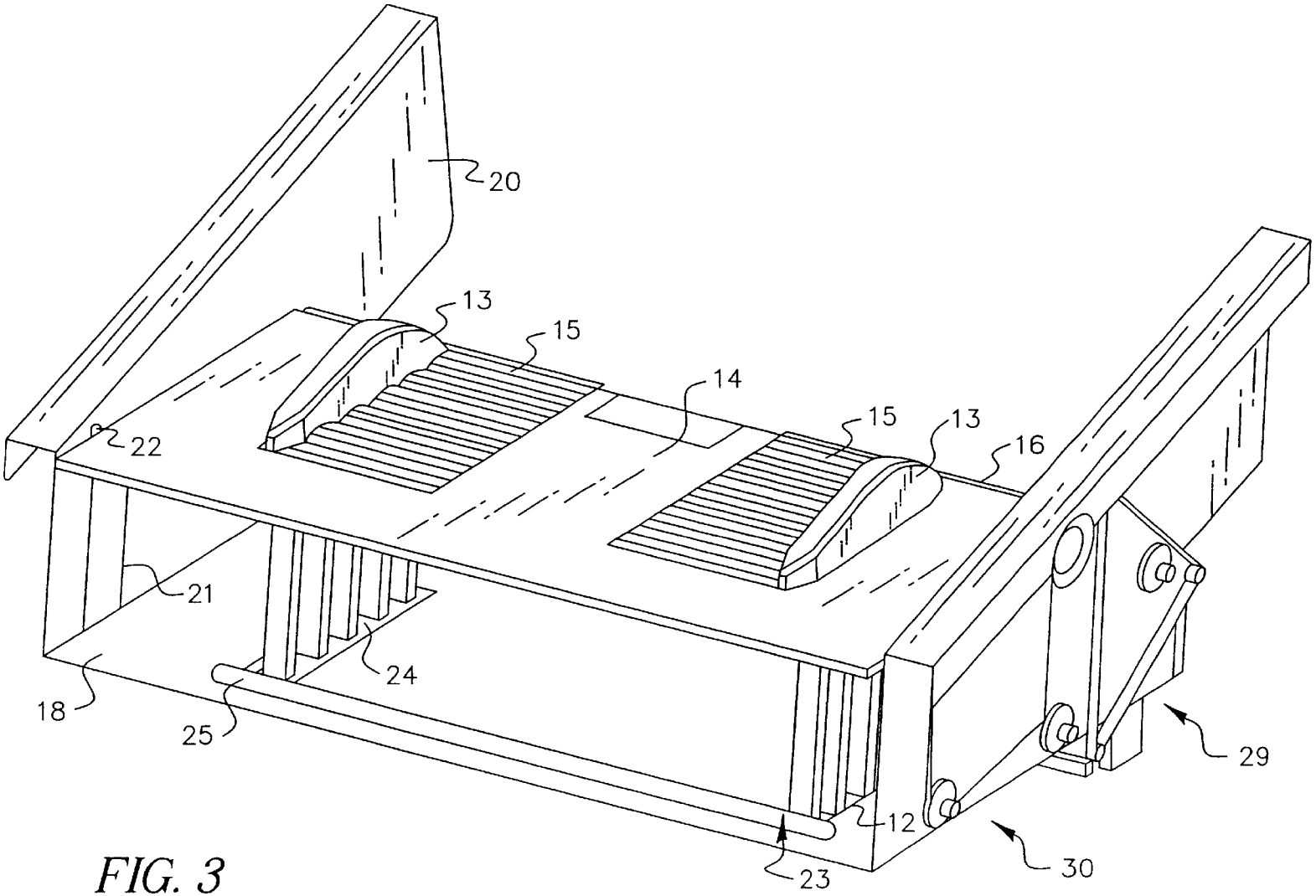
FIG. 3 is a perspective view of a media supply receptacle according to the present invention, shown without a receptacle door.

In FIG. 3, a receptacle 10 is shown without the optional receptacle door 17. The control rods 12 have their lower ends movably affixed to a base plate 18, which forms the base of the receptacle 10. In a preferred embodiment, the media adjustment guide members 11 are slidably mounted on the base plate 18. At least one, and preferably all, of the control rods 12 in each media adjustment guide 11 has its lower end movably affixed to the base plate 18. Since the guide members arc mounted directly to the frame of the machine and not the movable input tray, tolerance build-up is reduced, and more consistent alignment of the guides to the feed mechanism is provided. The guide members of the present invention control stack straightness, and also control skew, or rotation, of the documents.

With continued reference to FIG. 3, the input tray 14 automatically moves up from the base plate 18 to the guide caps 13 as the stack of media resting on the input tray is depleted. The input tray is generally parallel to and above the base plate 18. The input tray is most preferably inclined about 15 degrees from horizontal so that the media stack slopes slightly. The term "generally parallel to" is meant to include such slight inclines. The opening 19 between the base plate and the input tray may be covered by the flexible, movable receptacle door 17 for safety or aesthetic reasons.

In use, the media stack is inserted into the receptacle by dropping it onto the input tray between the guide members. The guide members can be adjusted if necessary to accommodate a different sized media. As the media is fed to the image forming/rendering apparatus, the stack dwindles and the input tray 14 rises.

As shown in FIGS. 1–3, opposite ends of the base plate 18 are bordered by two support frame walls 20, which are vertically positioned with respect to the generally horizontal base plate 18 and input tray 14. The support frame walls 20 are parallel to each other. The lead edge guide 16 at the rear of the receptacle is perpendicular to the two support frame walls. As shown in FIG. 1, the inside of each support frame wall 20 comprises one or more vertically inclined tracks 21 for guiding the input tray 14 up and down along the support frame walls. The left and right edges of the base plate 18 preferably have evaginations 22 which correspond to and fit into the tracks 21 to facilitate movement of the input tray along the support frame walls. The input tray is chain driven by a stepper motor (not shown). The movable receptacle door essentially rides along with the input tray.

The media supply receptacle 10 holds a stack of printable media prior to printing in an image forming apparatus. A preferred embodiment of the present invention has guide members which are about four inches in height and are sized for a maximum 1000 sheet capacity, but the invention can be extrapolated for higher or lower capacity. The adjustment guide members of the present invention are adjustable for a wide variety of media widths. The preferred embodiment of the present invention accommodates document widths between about 2.5 and 12 inches. The printers include one or more media receptacles capable of holding a supply of printable media, such as copier paper, report covers, transparencies, bank checks, envelopes, and postcards. Instead of a removable paper receptacle, the printer may have an attached paper feed receptacle leading to an opening in the printer housing. Paper feed receptacles may be inclined toward the printer openings.

Figure 4:
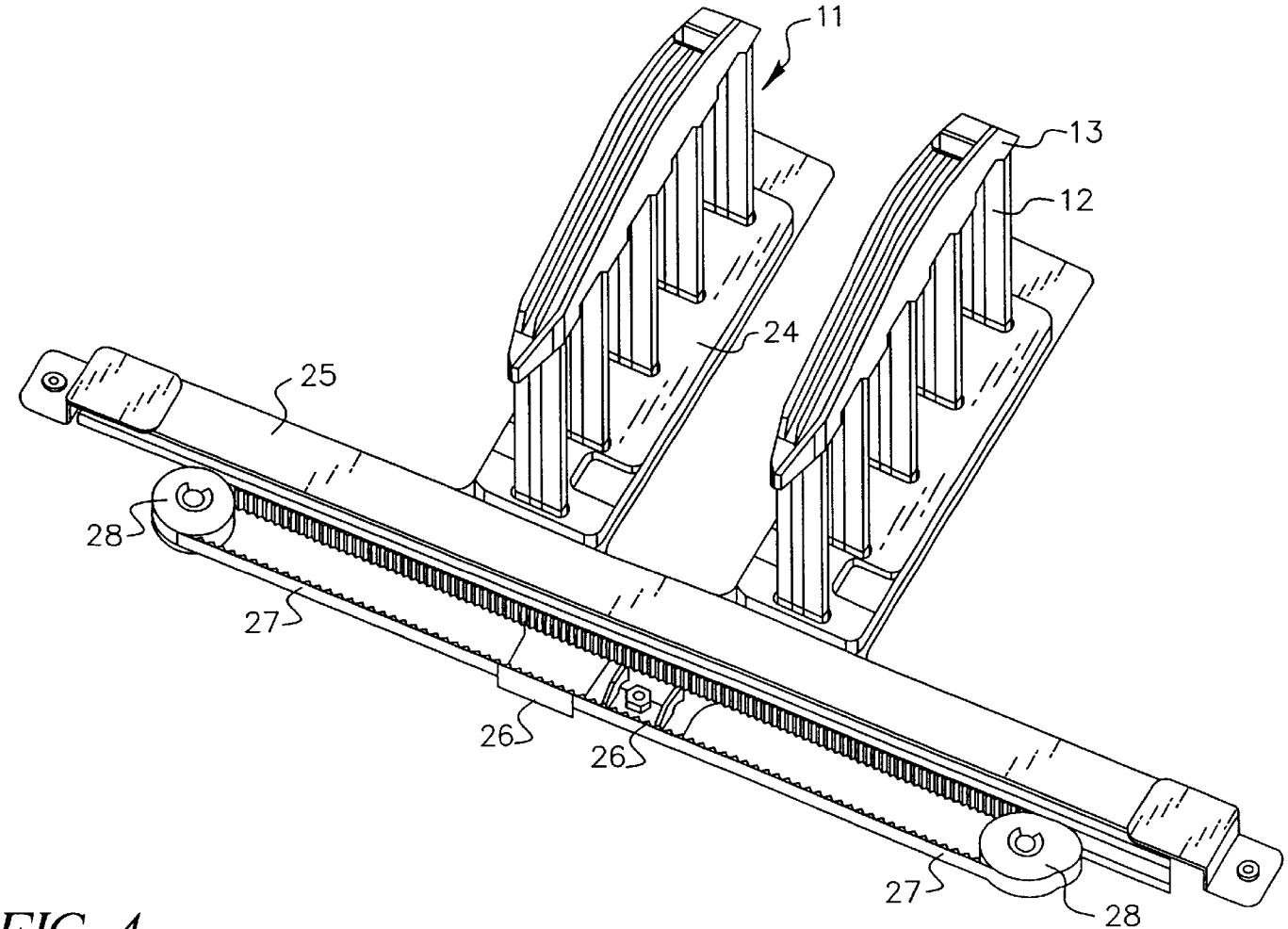
FIG. 4 is a perspective view of a guide member adjustment mechanism according to the present invention.
Figure 5:
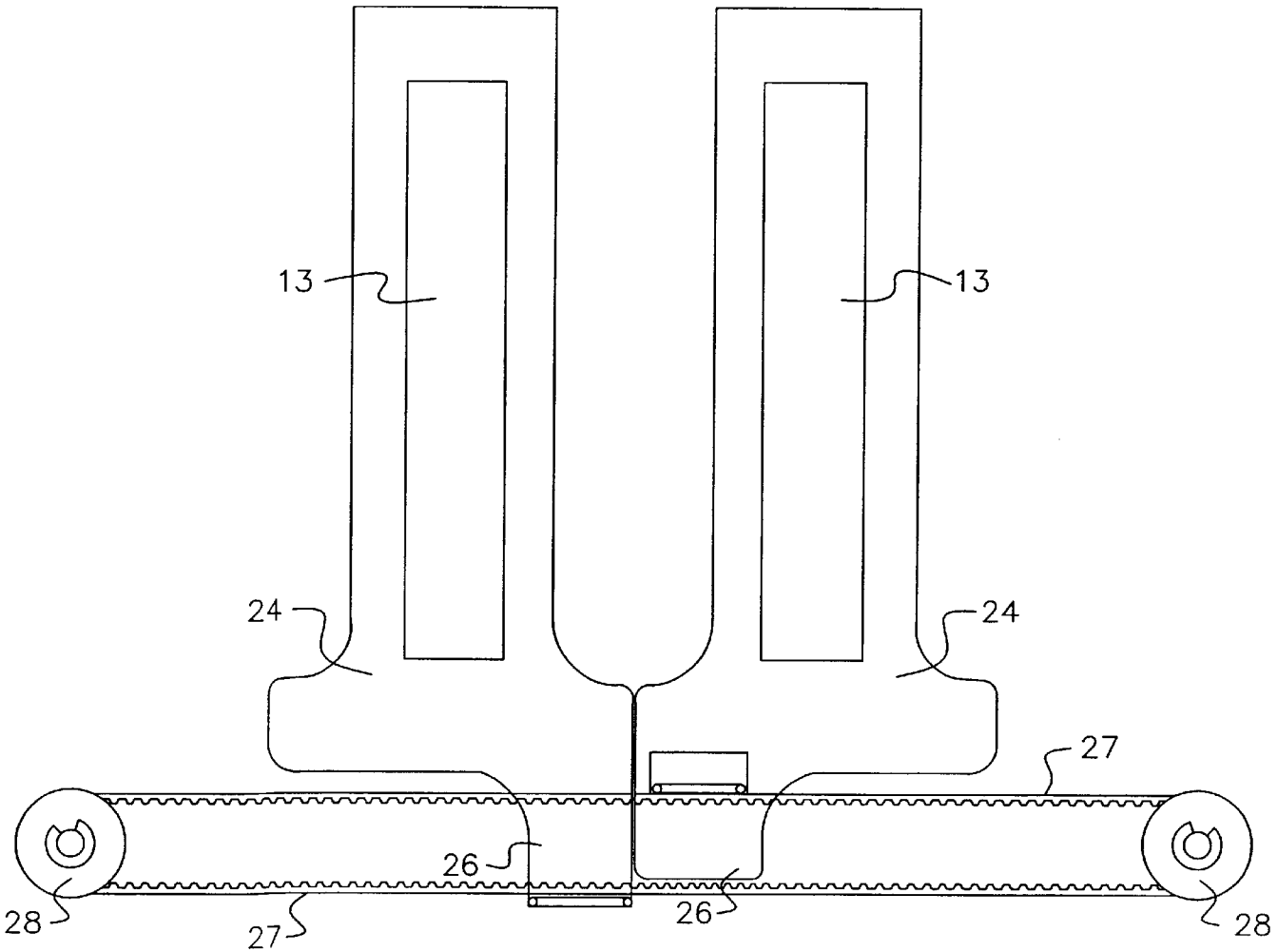
FIG. 5 is a top plan view of a guide member adjustment mechanism according to the present invention.

Referring to FIGS. 3–5, the receptacle 10 preferably includes an adjustment mechanism for moving the media adjustment guide members 11 left to right (horizontally) across the base plate 18. As shown in FIG. 3, an adjustment mechanism 23 is affixed to the upper surface of the base plate for automatically adjusting the guide members. Guide members of the present invention may also be manually adjustable. The guide members are movably affixed on guide plates 24, which are preferably made of metal. The front ends of the guide plates are affixed to a guide member track mechanism 25, which operates on ball bearings (not shown).

Referring to FIGS. 1–3, the receptacle 10 preferably comprises, or is connected to, a power-driven lift mechanism 29 for raising and lowering the input tray. Any suitable mechanism that raises and lowers the input tray will suffice for use herein. Despite the moving input tray, the presence of guide members on the receptacle of the present invention does not result in reduced precision in parallelism between the guides and the feeding mechanism due to tolerance build-up. The receptacle may also include a pulley and cable balance mechanism 30. The receptacle 10 feeds sheets of media from the top of the stack ("top-feeding") to the image forming/rendering apparatus. The scanner or printer optionally also include a puffer (air) and/or a friction feed device to help separate the top (uppermost) sheet of media from the next sheet for feeding to the printer or scanner.

Referring to FIGS. 4 and 5, tabs 26 at the front ends of each guide plate 24 are affixed to a toothed belt 27. As shown in FIG. 5, a right guide member is affixed to the inside of the toothed belt, which is closest to the guide members, and a left guide member is affixed to the outside of the toothed belt, which is the side farthest away from the guide members and towards the front of the base plate. The toothed belt 27 moves along two spaced apart pulleys 28. As the toothed belt 27 is moved along the pulleys, the guide members 11 are moved further apart to accommodate a wider stack of media, or closer together to accommodate a narrow stack of media. The motion of the guide members may be coordinated so that when one moves, the other moves, or they may move independently. The guide members are placed on opposite sides of the media stack in positions adjacent to the media.

Other suitable mechanisms for adjusting the media adjustment guides are included herein. The left and right guide members may be linked in such a manner that either guide member may be adjusted and the companion guide member will be moved an equal distance from the feeder centerline.

Thus, the input tray is attached to an external lifting mechanism. The control rods are capped with the solid edged guide cap, held in place by gravity or low force attachment device (e.g. magnet). Should any blockage occur below the lower portion of the guide, it simply lifts off its control surface (e.g. top of the control rod) and falls back into place when the input tray lowers.

The height of the control rods and guide cap are fixed. The guide cap is placed at the maximum feeder height. In operation, a paper stack of any height is raised by the input tray until the top of the stack is at the optimum feed point. Only the portion of the control rods required for that stack is therefore exposed, hence they are called here "disappearing guides." Operator access to shorter stacks of media is not compromised, and loading and adjustment of documents in the feeder is not complicated. The operator is less likely to scratch or bump himself or herself on the guides of the present invention. The edge of the guide cap provides skew control and the control rods guide the lower portions of the stack until the skew guiding faces are contacted. The receptacle of the present invention is also more aesthetically pleasing and "high tech" in appearance.

The media supply receptacle 10 may be an input device for a scanner or printer, for example. The term "printer" as used herein is intended to encompass any apparatus that prints an image onto paper, such as facsimile machines, photocopiers or printers associated with computer equipment such as dot matrix printers, bubble jet printers or laser printers. In a laser printer, a print mechanism includes a printhead within the housing for printing on a sheet of paper or other media. The print mechanism comprises a laser print mechanism. The present invention is particularly advantageous for high volume, high speed laser printers, and for supplying large batches of documents for electronic scanning.

Normally, a printer's media supply receptacle is adjacent to an opening in the printer's housing. The receptacle of the present invention may be hidden from view, as by enclosing it within the printer housing, for a more pleasing appearance. The paper or other media is loaded one sheet (or envelope, etc.) at a time in rapid succession from a stack from the media receptacle into the printer.

A preferred printer for use herein has automatic or manual selection controls for controlling operation of the printer, including the feeding of different paper size and type into the printer from the media supply receptacle. The printer controls are preferably electronic switches, including an "on/off" switch.

The present invention includes the adjustable media adjustment guides of the present invention for guiding a stack of printable media from a media supply receptacle into an image forming apparatus. A media adjustment guide according to this invention comprises:

a) a plurality of identical, evenly spaced control rods, each control rod being parallel to the others and vertically positioned with respect to the stack of printable media, each control rod having a lower end movably affixed to a base plate of the media supply receptacle, the control rods comprising at least one generally flat face each, the flat faces facing in the same direction and being adapted for contacting one side of the stack of printable media;

b) a guide cap affixed to an upper end of each control rod, each guide cap extending across the control rods in the guide member, the guide cap comprising at least one generally flat face adapted for contacting the side of the stack of printable media; and c) an adjustment mechanism for adjusting the position of the guide member along the base plate.

The guide members are vertically positioned with respect to the generally horizontally positioned base plate. The guide members are mounted directly to a frame of the image forming apparatus. This reduces tolerance build-up and provides more consistent alignment of the guides to the feed mechanism.

The invention has been described in detail with particular reference to certain preferred embodiments thereof, but it will be understood that variations and modifications can be effected within the spirit and scope of the invention. It is intended that the doctrine of equivalents be relied upon to determine the fair scope of these claims in connection with any other person's product that falls outside the literal wording of these claims, but which in reality does not materially depart from this invention.

PARTS LIST

10. Media supply receptacle
11. Media adjustment guide members
12. Control rods
13. Guide caps
14. Input tray
15. Control rod slots
16. Lead edge guide
17. Receptacle door
18. Base plate
19. Receptacle opening
20. Support frame walls
21. Tracks
22. Evaginations
23. Adjustment mechanism
24. Guide plate
25. Guide member track mechanism
26. Tabs on guide plates
27. Toothed belt
28. Toothed belt pulleys
29. Lift mechanism
30. Pulley and cable balance mechanism

What is claimed is:

1. A media supply receptacle for holding a stack of printable media prior to printing in an image forming apparatus, the receptacle comprising:

a) a horizontally inclined base plate having a generally flat upper surface;

b) a movable, slotted input tray generally parallel to and above the base plate, the input tray having a generally flat upper surface adapted for contacting a bottom sheet of a plurality of sheet media, the input tray being adapted for supporting the stack of sheet media;

c) a plurality of evenly spaced control rod slots in the input tray, each control rod slot being parallel to and set in the same plane as the other control rod slots;

d) at least one media adjustment guide member, each adjustment guide member comprising a plurality of generally identical, evenly spaced control rods, each control rod being vertically positioned with respect to the horizontally inclined input tray, at least one control rod passing through a corresponding control rod slot, at least one control rod having a lower end movably or immovably affixed to the base plate, and an opposite, upper end affixed to a guide cap, each guide cap extending across the upper ends of the control rods in the adjustment guide member and over the input tray; and wherein the receptacle is adapted for feeding the stack of sheet media in the receptacle to the adjacent image forming or rendering apparatus, a sheet at a time.

2. A receptacle according to claim 1 and further comprising a mechanism for moving the input tray up and down between the base plate and the guide caps within the receptacle.

3. A receptacle according to claim 1 wherein two opposite ends of the base plate are attached to support frame walls, which are vertically positioned with respect to the generally horizontal base plate and input tray, the support frame walls being parallel to each other.

4. A receptacle according to claim 3 further comprising a power-driven lift mechanism connected to a support frame wall for raising and lowering the input tray.

5. A receptacle according to claim 4 further comprising a flexible, movable tambour door with an upper edge affixed to a front edge of the input tray, and a lower edge affixed to a front edge of the base plate.

6. A receptacle according to claim 5 wherein the tambour door is comprised of a plurality of individual, parallel, side by side segments, the ends of the tambour door segments being movably affixed in tracks affixed to the support frame walls.

7. A receptacle according to claim 4 wherein the inside of each support frame wall comprises at least one vertically inclined track for guiding the input tray.

8. A receptacle according to claim 1 wherein there are two of the adjustment guide members, each parallel to the other and adapted for contact with an opposite side of the stack of printable media.

9. A receptacle according to claim 8 further comprising a lead edge guide positioned along one side of the receptacle in a direction perpendicular to the adjustment guide members, a generally flat inside face of the lead edge guide contacting a third side of the stack of printable media in the receptacle.

10. A receptacle according to claim 8 wherein the number of control rods in the adjustment guide members is the same as the number of control rod slots in the input tray, each control rod being movably positioned in one control rod slot.

11. A receptacle according to claim 1 further comprising a flexible, movable door on a front side of the receptacle, an upper edge of the receptacle door being affixed to a front edge of the input tray, a lower edge of the receptacle door being affixed to a front edge of the base plate, the receptacle door being adapted for moving up and down with the input tray.

12. A receptacle according to claim 1 wherein there are two identical, elongated guide caps, each of which comprises two opposite long side faces which are generally flat.

13. A receptacle according to claim 12 wherein there are two identical sets of the control rod slots centered along the right and left halves of the input tray, and two identical, elongated guide caps, each guide cap comprising a flat side face; each guide cap being about the same length as the width of the combined set of control rod slots.

14. A receptacle according to claim 1 wherein the guide caps are removably affixed to one or more upper ends of the control rods in a media adjustment guide member.

15. A receptacle according to claim 14 wherein the guide caps are held in place by gravity or a low force attachment device.

16. An adjustable media guide member for guiding a stack of printable media from a media supply receptacle into an image forming or rendering apparatus, the guide member comprising:

a) a plurality of identical, evenly spaced control rods, each control rod being parallel to the others and vertically positioned with respect to the stack of printable media, each control rod having a lower end movably affixed to a base plate of the media supply receptacle, the control rods comprising at least one generally flat face each, the flat faces facing in the same direction and being adapted for contacting one side of the stack of printable media;

b) a guide cap affixed to an upper end of each control rod, each guide cap extending across the control rods in the guide member, the guide cap comprising at least one generally flat face adapted for contacting the side of the stack of printable media; and c) an adjustment mechanism for adjusting the position of the guide member along the base plate; and wherein the guide member is vertically positioned with respect to the generally horizontally positioned base plate.

17. A guide member according to claim 16 wherein the guide member is mounted to a base plate of the receptacle.

18. A guide member according to claim 16 wherein the guide cap is elongated, with a curved upper surface.

* * * * *